United States Patent [19]

Dworkin

[11] 4,301,945

[45] Nov. 24, 1981

[54] TOOTHPASTE DISPENSER

[76] Inventor: Eugene Dworkin, 16-66 Bell Blvd., Bayside, N.Y. 11360

[21] Appl. No.: 133,639

[22] Filed: Mar. 24, 1980

[51] Int. Cl.[3] ..... B65D 35/34

[52] U.S. Cl. ..... 222/100

[58] Field of Search ..... 222/97, 98, 99, 100

[56] References Cited

U.S. PATENT DOCUMENTS 3,473,698 10/1969 Ballin ..... 222/100
3,525,457 8/1970 Hausmann et al. ..... 222/100
3,885,708 5/1975 Parry ..... 222/100
3,910,460 10/1975 Hausmann et al. ..... 222/99

*Primary Examiner*—Robert J. Spar
*Assistant Examiner*—Frederick R. Handren
*Attorney, Agent, or Firm*—Kirschstein, Kirschstein, Ottinger & Cobrin

[57] ABSTRACT

The closed end of a toothpaste tube is inserted into an internal cavity of a self-supporting toothpaste dispensing device, and a key is manually turned to coil the tube within the cavity. The cavity walls are resiliently yieldable and constantly bear against different contact zones on the coiled tube to empty its paste contents.

12 Claims, 3 Drawing Figures

FIG. 1
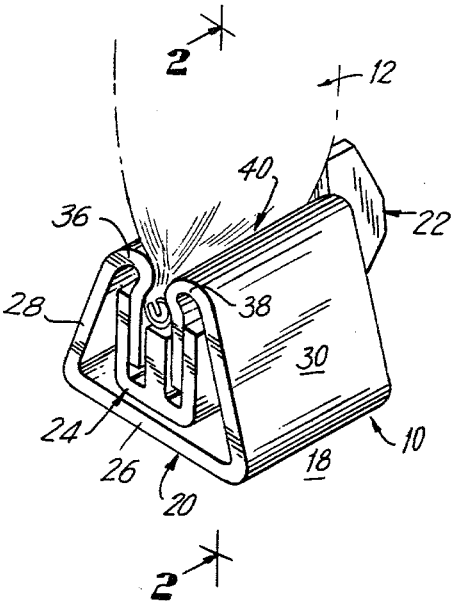
FIG. 2
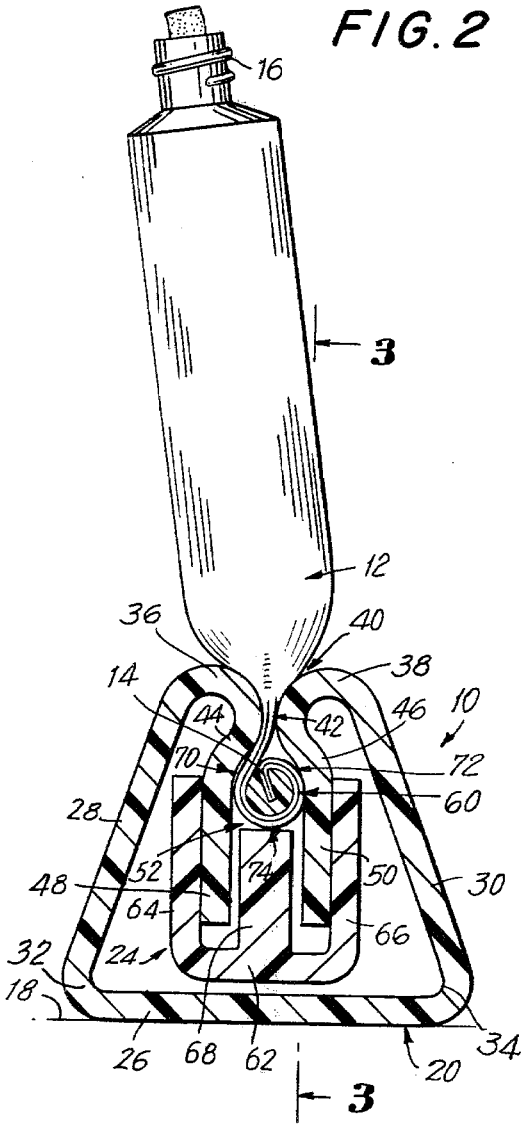
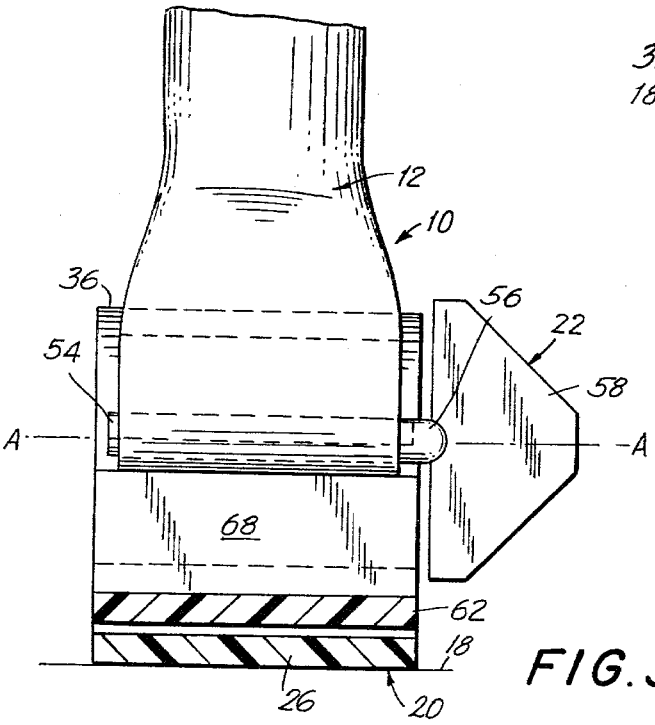
FIG. 3

TOOTHPASTE DISPENSER

BACKGROUND OF THE INVENTION

1. Field of the Invention

This invention relates to dispensing devices for manually emptying the paste contents from collapsible tubes such as toothpaste tubes.

2. Description of the Prior Art

Dispensers for manually emptying the paste contents from toothpaste tubes are well known. Such dispensers generally comprise a ceramic stand, and a manually-turnable key for coiling the tube. The key is typically either journalled in holes formed in the ceramic stand, or spring-mounted on the stand.

However, the known toothpaste dispensers have not proven to be altogether satisfactory in use. One source of dissatisfaction is that the ceramic stand is prone to breakage due to the brittle nature of the ceramic material. This is particularly true for the bathroom environment where had sink and floor surfaces are common.

Another major drawback is that the known dispensers do not substantially empty the paste contents from the toothpaste tube. The coiled tubular portion is generally not tightly wrapped around the key, i.e. not fully squeezed, thereby resulting in lost paste and inefficient operation.

SUMMARY OF THE INVENTION

1. Objects of the Invention

Accordingly, it is the general object of the present invention to overcome the aforementioned drawbacks of the prior art.

Another object of the present invention is to reliably and substantially completely empty the paste contents from collapsible tubes.

Still another object of this invention is to provide a dispenser which is not prone to breakage.

Another object of this invention is to provide a dispenser which is attractive in appearance and inexpensive to manufacture.

2. Features of the Invention

In keeping with these objects and others which will become apparent hereinafter, one feature of the invention resides, briefly stated, in a light-weight, self-supporting, portable dispensing device for manually emptying the paste contents from collapsible tubes, particularly toothpaste tubes. The dispensing device comprises stand means, manually-operated means, and retainer means.

The stand means supports the elongated, paste-containing, collapsible tube above a support surface. In a preferred embodiment, the stand has a pyramidal-like configuration and has a broad base for engaging the support surface, and a low center of gravity to resist being tipped over.

The stand has resilient mouth-forming wall portions which resiliently bear against opposite sides of the tube and form a mouth through which the tube passes lengthwise from its closed towards its opposite dispensing end.

The stand also has resilient cavity-forming wall portions and resilient extension wall portions which together bound a cavity which communicates with the mouth.

The manually-operated means or key has a longitudinal slot for receiving the crimp-seal closed end of the tube, and is turnable about a turning axis for successively drawing the tube lengthwise through the mouth and thereupon into the cavity. Concomitantly, the drawn-in tube portions are successively coiled about the key.

The retainer means retains the coiled tubular portion and the key in the cavity. The retainer means is mounted on the extension wall portions for sliding movement relative thereto. As the key is turned, more portions of the tube are coiled about the key, and the retainer means resiliently yields in a sliding manner in order to enlarge the volume of the cavity for accommodating the larger coiled tubular portion in the cavity.

The retainer means as well as the cavity-forming wall portions all constantly resiliently bear against different contact zones on the coiled tubular portion. These contact zones are spaced apart of each other circumferentially about the turning axis, and also sequentially as considered lengthwise along the tube. In accordance with this invention, the resilient nature of the cavity walls insures a constant squeezing of the tube, and a successive emptying of the paste contents in a more complete manner than heretofore obtained.

The stand means, key and retainer means are all preferably constituted of a synthetic plastic material such as Lucite. This permits the aforementioned components to be molded with a sculptured modernistic appearance, thereby creating an attractive bathroom decor. The plastic material is preferably transparent for aesthetic purposes, in order to match and blend the dispenser in to the existing bathroom color scheme. The plastic material is preferably resilient in order to withstand shock and breakage in the event that the dispenser is accidentally dropped.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of the dispenser device in accordance with this invention;

FIG. 2 is an enlarged sectional view as taken on line 2—2 of FIG. 1; and FIG. 3 is an enlarged sectional view as taken on line 3—3 of FIG. 2.

DETAILED DESCRIPTION OF THE PREFERRED EMBODIMENTS

Turning now to the drawings, reference numberal 10 generally identifies a portable stand-alone dispensing device for manually emptying the paste contents from collapsible tubes. One such tube is an elongated, paste-containing, collapsible toothpaste tube 12 which has a crimp-seal closed end 14, and an opposite openable dispensing end 16. It will be expressly understood that the dispenser 10 is not intended to be limited solely to toothpaste tubes, but can be utilized to dispense the paste contents from any type of collapsible tube. The invention is described in connection with toothpaste tubes merely for ease of explanation.

The dispensing device 10 comprises stand means or housing 20, a manually-operated turning means or key 22, and a retainer means or clip 24.

The housing 20 includes a broad rectangular-shaped base wall 26 for supportably engaging a working surface such as desk top 18, and a pair of rectangular-shaped side walls 28,30 located at opposite sides of the base wall 26 and extending upwardly therefrom. The side walls 28,30 converge towards each other in upward direction away from the base wall, and together with the base wall 26, form a generally pyramidal-like configuration which has a low center of gravity, and is therefore resistant to being tipped over. The corner bends 32,34 have large radii of curvature, on the order of about $\frac{1}{4}''$, in order to impart structural integrity to the housing and reinforce it against forces tending to move the two side walls 28,30 apart from each other.

Resilient mouth-forming wall portions 36,38 are integrally formed at the upper parts of the side walls 28,30, respectively. The mouth-forming wall portions 36,38 are spaced apart of each other to constantly resiliently bear against the opposite sides of the tube, and bound a longitudinally-extending slot or mouth 40 through which the tube 12 passes in lengthwise direction from its closed end 14 towards its dispensing end 16. The mouth-forming wall portions 36,38 are mirror-symmetrical and are convexly curved along arcs whose radii of curvature are typically on the order of $\frac{1}{4}''$. The convexly-curved wall portions 36,38 converge towards each other, as considered in the direction of passage of the tube through the mouth 40. Thus, the outer end of the mouth 40 is flared so as to facilitate entry of the tube through the mouth 40. The convexly-curved wall portions 36,38 terminate at throat 42 which has the narrowest cross-sectional dimension.

Resilient cavity-forming wall portions 44,46 are integrally formed with, and extend downwardly away from the mouth-forming wall portions 44,46, respectively. The cavity-forming wall portions 44,46 are mirror-symmetrical and are concavely curved along arcs whose radii of curvature are typically on the order of $\frac{1}{4}''$. The concavely-curved wall portions 44,46 diverge away from each other, as considered in the direction of the passage of the tube. Thus, the inner end of the mouth 40 is likewise flared so as to facilitate exit of the tube from the mouth 40. The concavely curved wall portions 44,46 diverge outwardly from the throat 42, and together with the convexly-curved wall portions 36,38, form a venturi-shaped passage through which the tube passes.

Resilient extension wall portions 48,50 are integrally formed with, and extend linearly downwardly from, the concavely-curved wall portions 44,46, repsectively. The extension wall portions are mirror-symmetrical and extend generally parallel to each other to free ends which terminate short of the base wall 26. The extension wall portions and the concavely-curved wall portions are spaced apart of each other and together bound opposite lateral sides of a cavity 52 which openly communicates with the mouth 40.

The key 22 is located in the cavity 52 and retained therein by the retainer means 24, as described below. The key 22 includes a cylindrical pin 54 formed with a longitudinally-extending slot 56 in which the crimp-seal end 14 is received and frictionally retained. A handle 58 is connected to the pin 54 exteriorly of the housing 20 in order to manually turn the pin about the turning axis A-A (See FIG. 3).

In operation, the key 22 is manually turned, and the tube is successively drawn lengthwise through the mouth 40 and thereupon into the cavity. The tube is successively coiled about the pin 54 to form a coiled tubular portion 60 in the cavity 52.

The retaining means or clip 24 is mounted on the extension wall portions 48,50. The clip 24 includes a base section 62 which extends between and underneath the extension wall portions 48,50; a pair of side sections 64,66 located at opposite lateral sides of the base section 62 and extending linearly normally of the latter; and a central support section 68 which lies intermediate the side sections 64,66 and extends linearly normally away from the base section and into the cavity 52. The central support section 68 is operative to retain the key 22 and the coiled tubular portion 60 in the cavity 52.

The clip 24 is generally E-shaped and is mounted on the extension wall portions 48,50 for sliding movement relative thereto. The clip 24 is a discrete piece separate from the housing 20. The side sections 64,66 are spaced apart of each other by a fixed predetermined distance. Prior to assembly, the extension wall portions are molded such that they assume a non-stressed (relaxed) relative orientation in which the extension wall portions 48,50 are spaced apart of each other by a given distance which is greater than said fixed predetermined distance. After mounting the clip such that the side sections 64,66 overlap the outer surfaces of the extension wall portions 48,50, the latter are urged towards each other, and assume the stressed (non-relaxed) relative orientation shown in the drawings. The outward tendency of the extension wall portions to return to their relaxed orientation serves to retain the clip on the extension wall portions.

The central support section 68 is spaced remotely from i.e. out of contact with, the extension wall portions, as shown in FIG. 2. This reduces friction and facilitates the resilient yielding, i.e. the sliding movement of the clip downwardly towards the base wall 26 in a controlled manner, as discussed below.

The resilient cavity-forming wall portions 44,46 have concavely-curved interior surfaces which face each other. These concavely-curved interior surfaces constantly resiliently bear on upper locations of the coiled tubular portion 60 at contact zones 70,72. The contact zones 70,72 are located on opposite sides of, and above, the turning axis A-A.

The end face of central support section 68 has a planar surface which is located below the turning axis A-A and which constantly resiliently bears on a lower location of the coiled tubular portion 60 at contact zone 74.

The contact zones 70,72,74 are all resiliently yieldable to permit the cavity 52 to increase in volume to accommodate the attendant increase in volume of the coiled tubular portion 60 during further turning of the key. The clip 24 slides downwardly towards the base wall 26, because the ever-growing coiled tubular portion 60 pushes down on the central support section 68. However, the contact zone 74 always remains in physical contact with the outermost convolution of the coiled tubular portion 60 all during the sliding movement of the clip.

The contact zones 70,72,74 are spaced circumferentially apart of each other about the turning axis. The contact zones are spaced along the tube as considered in a lengthwise direction form the closed end of the tube towards its dispensing end.

The constant resilient bearing of the resilient walls bounding the cavity 52 serves to substantially empty the paste contents from the coiled tubular portion 60, and to permit the latter to be tightly wrapped around the pin 56 of the key.

The housing 20, key 22 and clip 24 are all constituted of a resilient moldable synthetic plastic material, preferably Lucite. The resilient housing is molded such that the extension wall portions 48,50 can be urged from an initial, unassembled relaxed orientation to an assembled, stressed orientation, and thereupon, to return due to its own inherent resilience to its relaxed orientation when the urging forces have been removed.

The plastic components 20,22,24 are light-in-weight and inexpensive to manufacture. Preferably, the components are constituted of a transparent material so that the dispenser can blend in with any existing bathroom color scheme.

It will be understood that each of the elements described above, or two or more together, may also find a useful application in other types of constructions differing from the types described above.

While the invention has been illustrated and described as embodied in a toothpaste dispenser, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adptations should and are intended to be comprehended within the meaning and range of equivalence of the following claims.

What is claimed as new and desired to be protected by Letters Patent is set forth in the appended claims.

1. A light-weight, self-supporting, portable dispensing device for manually emptying the paste contents from collapsible tubes, comprising:

(a) stand means for supporting an elongated, paste-containing collapsible tube above a support surface, said stand means having resilient mouth-forming wall portions spaced apart of each other to resiliently bear against opposite sides of the tube and bounding longitudinally-extending mouth through which the tube passes lengthwise from its closed end towards its opposite dispensing end, said stand means also having resilient cavity-forming wall portions spaced apart of each other and extending away from the mouth-forming wall portions to bound a cavity which communicates with said mouth, said stand means further having resilient extension wall portions extending away from said cavity-forming wall portions;

(b) manually-operated means located in said cavity for holding the closed end of the tube, and being turnable about a longitudinally-extending turning axis for successively drawing the tube lengthwise through said mouth and thereupon into said cavity, and for concomitatnly successively coiling the drawn-in tube portions about said turning axis to form a coiled tubular portion in said cavity; and (c) retainer means mounted on the stand means and extending below the manually-operated means and the coiled tubular portion for retaining both the former and the latter in said cavity, said retainer means and said cavity-forming wall portions being resiliently yieldable to permit said cavity to increase in volume to accommodate an increase in volume of the coiled tubular portion due to further coiling, said resiliently yieldable retainer means and said resilient cavity-forming wall portions all constantly resiliently bearing at different contact zones on the coiled tubular portion, said contact zones being spaced apart of each other circumferentially about said turning axis and sequentially, as considered in lengthwise direction of the tube, for successively emptying the paste contents from the coiled tubular portion, said retainer means being mounted on said extension wall portions for sliding movement relative thereto.

2. The dispensing device as defined in claim 1, wherein said stand means has a base wall for engaging the support surface, and a pair of side walls located at opposite sides of the base wall and extending upwardly therefrom.

3. The dispensing device as defined in claim 2, wherein said side walls converge towards each other in direction away from said base wall to form a generally pyramidal-like configuration for the stand means.

4. The dispensing device as defined in claim 1, wherein said mouth-forming wall portions are mirror-symmetrical, arc-shaped, and converge towards each other in the direction of passage of the tube through said mouth and into said cavity.

5. The dispensing device as defined in claim 1, wherein said cavity-forming wall portions are mirror-symmetrical, arc-shaped, and diverge away from each other in the direction of passage of the tube through said mouth and into said cavity.

6. The dispensing device as defined in claim 1, wherein said mouth-forming wall portions and said cavity-forming wall portions respectively converge towards, and diverge from, each other as considered in the direction of passage of the tube through said mouth and into said cavity; and wherein said mouth-forming wall portions and said cavity-forming wall portions are connected to each other and form a venturi-shaped passage through which the tube passes.

7. The dispensing device as defined in claim 1, wherein said manually-operated means includes an axially-extending pin having a longitudinal slot for reception of the closed end of the tube, and handle means connected to the pin for turning the latter about said turning axis.

8. The dispensing device as defined in claim 1, wherein said retainer means includes a base section extending between the extension wall portions, a pair of side sections located at opposite sides of the base section and extending away from the same, and a central support section intermediate the pair of side sections and extending away from the base section for retaining the manually-operated means and the coiled tubular portion in said cavity.

9. The dispensing device as defined in claim 8, wherein said side sections of the retainer means are spaced apart of each other at a distance which is less than the spaced-apart distance between the extension wall portions assumed by the latter when the retainer means is not mounted on the stand means, to thereby urge said extension wall portions twoards each other under tension when the retainer means is mounted on the extension wall portions.

10. The dispensing device as defined in claim 8, wherein said central support section of the retainer means is spaced out of contact with the extension wall portions.

11. The dispensing device as defined in claim 1, wherein said stand means and said retainer means are constituted by a lightweight resilient synthetic plastic material.

12. A lightweight, self-supporting, portable dispensing device for manually emptying the paste contents from collapsible tubes, particularly toothpaste tubes, comprising:

(a) stand means for supporting an elongated, paste-containing, collapsible tube above a support surface, said stand means including a base portion for engaging the support surface, and a pair of side walls located at opposite sides of the base portion and extending upwardly therefrom, said stand means having resilient mouth-forming wall portions located on said side walls of the stand means and being spaced apart of each other to constantly resiliently bear against opposite sides of the tube, said mouth-forming wall portions bounding a longitudinally-extending mouth through which the tube passes lengthwise from its closed end towards its opposite dispensing end, and resilient cavity-forming wall portions spaced apart of each other and extending away from the mouth-forming wall portions to bound a cavity which communicates with said mouth, said cavity-forming wall portions including resilient extension wall portions extending away from said cavity-forming wall portions and bounding opposite sides of said cavity;

(b) manually-operated means located in said cavity for holding the closed end of the tube, and being turnable about a longitudinally-extending turning axis for successively drawing the tube lengthwise through said mouth and thereupon into said cavity, and for concomitantly successively coiling the drawn-in tube portions about said turning axis to form a coiled tubular portion in said cavity; and (c) retainer means mounted on said extension wall portions for sliding movement relative thereto, said retainer means including a base section extending between the extension wall portions, a pair of side sections located at opposite sides of the base section and extending away from the same, and a central support section intermediate the pair of side sections and extending away from the base section for retaining the manually-operated means and the coiled tubular portion in said cavity, said retainer means and said cavity-forming wall portions being resiliently yieldable to permit said cavity to increase in volume to accommodate an increase in volume of the coiled tubular portion due to further coiling, said resiliently yieldable retainer means and said resilient cavity-forming wall portions all constantly resiliently bearing at different contact zones on the coiled tubular portion, said contact zones being spaced apart of each other circumferentially about said turning axis and sequentially, as considered in lenthwise direction of the tube, for successively emptying the paste contents from the coiled tubular portion.

* * * * *